US009768489B2

(12) United States Patent
Lebayon et al.

(10) Patent No.: US 9,768,489 B2
(45) Date of Patent: Sep. 19, 2017

(54) JOINING DEVICE FOR FASTENING A RADOME ONTO AN ANTENNA REFLECTOR

(71) Applicant: Alcatel Lucent, Boulogne Billancourt (FR)

(72) Inventors: Armel Lebayon, Trignac (FR); Loic Isambard, Trignac (FR); Samuel Siret, Nantes (FR)

(73) Assignee: Alcatel Lucent, Boulogne-Billancourt (FR)

( * ) Notice: Subject to any disclaimer, the term of this patent is extended or adjusted under 35 U.S.C. 154(b) by 0 days.

(21) Appl. No.: 14/430,663

(22) PCT Filed: Sep. 23, 2013

(86) PCT No.: PCT/IB2013/058771

§ 371 (c)(1),
(2) Date: Mar. 24, 2015

(87) PCT Pub. No.: WO2014/045253

PCT Pub. Date: Mar. 27, 2014

(65) Prior Publication Data

US 2015/0249281 A1 Sep. 3, 2015

(30) Foreign Application Priority Data

Sep. 24, 2012 (EP) ..... 12306151

(51) Int. Cl.
*H01Q 1/42* (2006.01)
*H01Q 1/12* (2006.01)
*H01Q 15/16* (2006.01)

(52) U.S. Cl.
CPC ..... *H01Q 1/1207* (2013.01); *H01Q 1/42* (2013.01); *H01Q 15/16* (2013.01)

(58) Field of Classification Search
CPC ..... H01Q 1/1207; H01Q 1/42; H01Q 15/16
See application file for complete search history.

(56) References Cited

U.S. PATENT DOCUMENTS 3,351,947 A 11/1967 Hart
8,077,113 B2 * 12/2011 Syed ..... H01Q 1/42 343/872

(Continued)

FOREIGN PATENT DOCUMENTS

CN 101194394 A 6/2008
CN 201369389 Y 12/2009

(Continued)

OTHER PUBLICATIONS

International Search Report for PCT/IB2013/058771 dated Apr. 3, 2014.

*Primary Examiner* — Hoang Nguyen
(74) *Attorney, Agent, or Firm* — Fay Sharpe, LLP

(57) ABSTRACT

A joining device to enable the fastening of a rigid flat radome onto a circular-opening reflector comprises an upper brace applied to one outward-turned side of the radome and covering the peripheral segment of the reflector and radome, a lower brace placed against the face of the reflector opposite the radome, and a rigid spacer comprising and joined with a pad disposed between the reflector and the radome, at least one cylinder leaving a through-hole for a means of fastening the radome onto the reflector, and at least one peg mating with the radome. The upper brace covers the peg and comprises an orifice for putting the cylinder through. In an antenna comprising a circular-opening reflector, a rigid flat radome comprising a plurality of holes on its periphery, and such a joining device, only some of the holes of the radome are used to allow a means of fastening through.

12 Claims, 3 Drawing Sheets

(56) References Cited

U.S. PATENT DOCUMENTS

| | | | | |
|---|---|---|---|---|
| 9,050,692 | B2 * | 6/2015 | Wright | H01Q 19/12 |
| 9,083,083 | B2 * | 7/2015 | Hills | H01Q 1/42 |
| 2005/0190116 | A1 | 9/2005 | Syed et al. | |
| 2007/0045467 | A1 | 3/2007 | Jeanneau et al. | |
| 2011/0140983 | A1 | 6/2011 | Hills et al. | |

FOREIGN PATENT DOCUMENTS

| | | | |
|---|---|---|---|
| CN | 101924276 | A | 12/2010 |
| CN | 201859944 | U | 6/2011 |
| CN | 102232258 | A | 11/2011 |
| DE | 102008052355 | A1 | 4/2010 |
| JP | 5-136618 | A | 6/1993 |
| JP | 4137353 | B2 | 6/2008 |
| JP | 2010278736 | A | 12/2010 |
| JP | 2011-249959 | A | 12/2011 |

* cited by examiner

JOINING DEVICE FOR FASTENING A RADOME ONTO AN ANTENNA REFLECTOR

The present invention pertains to a joining device for fastening a radome onto a reflector, intended to be used in concave reflector antennas having, for example, the shape of at least one parabola portion, the reflector potentially having a shroud.

Parabolic reflector antennas are normally used for mobile communication networks. Such an antenna comprises a main reflector having a concavity having the shape, for example, of a paraboloid of revolution around the antenna's axis of symmetry, and a feed device located along the antenna's axis of symmetry to transmit the electromagnetic waves emitted or received by the antenna.

It is associated with a radome that has an impermeable protective surface enclosing the space defined by the reflector relative to the outside. This radome may be flexible or rigid. A flat rigid radome, the most commonly used kind today, exhibits the advantage of good resistance to the outside climate environment, such as rain, wind, or snow. It is therefore essential to ensure solid fastening capable, in particular, of resisting wind pressure, in particular for large-diameter reflectors. The fastening system must also enable fast disassembly/reassembly that does not damage the radome on the reflector.

A flat, relatively rigid radome is most commonly fastened to the reflector using various devices whose common element is the need for a plurality of screws or bolts placed on the periphery of the radome. In order to meet the standards of resistance to environmental conditions, the number of bolts is high. However, the presence of so many metal bolts and the unevenness that they form on the radome may lead to a degradation in the antenna's radio performance.

It is a purpose of the present invention to eliminate the drawbacks of the prior art, and in particular a joining device to enable the fastening of a flat and rigid radome onto a circular-opening reflector that implements fewer fastening elements, such as screws, pins, bolts, etc. than known systems, while ensuring reliable fastening that withstands environmental conditions.

A further purpose of the invention is to propose a joining device adapted to fasten a radome formed of a rigid material such as a non-thermoprocessable material, for instance a low-density multilayer or "honeycomb" material.

A further purpose of the invention is to propose a fastening device that is also inexpensive and easy to implement, during both assembly and disassembly.

The subject matter of the present invention is a device for joining a rigid flat radome onto a circular-opening antenna reflector comprising

- an upper brace applied to the surface of the radome, turned outward and covering the peripheral segment of the reflector and radome,
- a lower brace placed against an outer surface of the reflector opposite the radome, and
- a rigid spacer comprising and joined with a pad disposed between the reflector and the radome, at least one cylinder leaving a through-hole for a means of fastening the radome onto the reflector, and at least one peg mating with the radome.

According to a first aspect, the upper brace covers the upper part of the peg.

According to a second aspect, the upper brace comprises an orifice for putting the cylinder through.

According to a third aspect, the cylinder is shaped like a hollow tube passing through the pad and capable of fitting into an orifice of the upper brace.

According to a fourth aspect, the distance separating one peg from a cylinder or an adjacent peg is constant.

According to a fifth aspect, the spacer is made of a dielectric material.

According to a sixth aspect, the means of fastening the radome onto the reflector is a bolt equipped with a nut.

The benefit of this joining device is to make it possible to not reduce the number of holes normally used to fasten the radome, and therefore to preserve the solidity of the connection between the radome and the joining device, while reducing the risk of disrupting the radio performance of the antenna. Additionally, the number of bolts to install is reduced, which enables significant saved time when installing the antenna.

A further subject matter of the invention is an antenna comprising a circular-opening reflector, a rigid flat radome, and a device for joining the radome onto the reflector, the radome comprising a plurality of holes distributed across its periphery, wherein some of the holes of the radome are used to put the means of fastening through. Preferentially, only one-third of the radome's holes are used to put the means of fastening through.

According to another aspect, the joining device comprises

- an upper brace applied to the surface of the radome, turned outward and covering the peripheral segment of the reflector and radome,
- a lower brace placed against an outer surface of the reflector opposite the radome,
- at least one rigid spacer comprising and joined with a pad disposed between the reflector and the radome, at least one cylinder leaving a through-hole for a means of fastening the radome onto the reflector, and at least one peg, the cylinder and the peg having an outer diameter adapted to be inserted into the radome's holes.

Other characteristics and advantages of the present invention will become apparent upon reading the following description of one embodiment, which is naturally given by way of a non-limiting example, and in the attached drawing, in which.

Identical elements in each of these figures have the same reference numbers.

Figure 1:
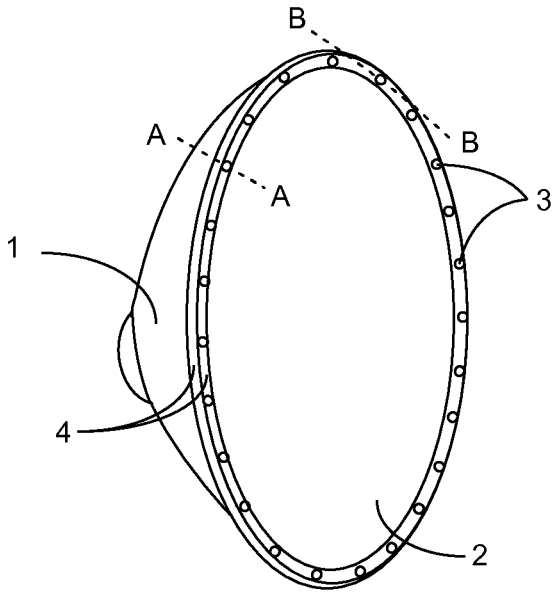
FIG. 1 depicts a perspective view of a parabolic antenna reflector equipped with a flat rigid radome joined by means of a joining device.

In the embodiment depicted in FIG. 1, a concave reflector 1, particularly a parabolic one with a circular opening, belonging e.g. to a microwave antenna, is covered by a flat, rigid, and circular radome 2. The radome 2 must be able to withstand outdoor conditions, sometimes extreme ones, for several years. In particular, the radome must be strong enough mechanically to tolerate winds whose velocities may reach 300 Km/h. The radome 2, for example one 1 meter in diameter, is fastened onto the lip forming the edge of the reflector 1 by a joining device comprising a plurality of means of fastening, such as bolts 3, disposed at regular intervals on the periphery of the radome 2.

In this embodiment, the number of bolts 3, for example twenty-four bolts in this case, is less than in known antennas with the same diameter that normally comprise seventy-two bolts in order to achieve the necessary mechanical strength. A radome of this sort therefore normally comprises seventy-two holes regularly spaced along the entire periphery. In the present situation, only one in three holes receives a means of fastening such as a bolt 3.

Figure 2:
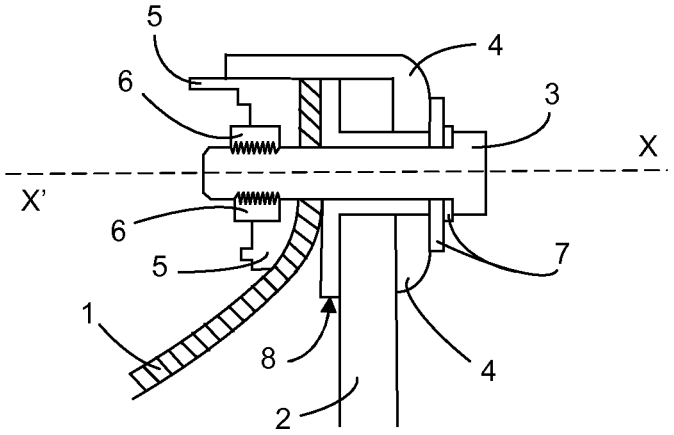
FIG. 2 depicts a transversal cross-section along A-A of the edge of the antenna at the point of a means of fastening.

FIG. 2 depicts, in a transversal cross-section along A-A, the joining of the radome 2 onto the reflector 1 at the point of the bolt 3. The joining device comprises an upper brace 4 applied to the edge of the outward-turned surface of the radome 2, which is folded so as to cover the segment of the peripheral edges of the reflector 1 and radome 2. The joining device also comprises a lower brace 5 whose shape mates with that of the edge, forming the lip, of the outer surface of the reflector 1 opposite the radome 2. The upper brace 4 and the lower brace 5 mating in such a way that the edges of the reflector 1 and radome 2 are simultaneously caught between the upper brace 4 and the lower brace 5. The upper brace 4, the reflector 1, the radome 2, and the lower brace 5 are perforated in order to allow through means of fastening with the axis X-X', such as pins or bolts 3, held in place by nuts 6 and potentially associated with washers 7. Once the means of fastening 3, 6, 7 have been put in place, the radome 2 can no longer be dissociated from the reflector 1. A spacer 8 is disposed between the reflector 1 and the radome 2 and extends into the thickness of the radome 2.

Figure 3:
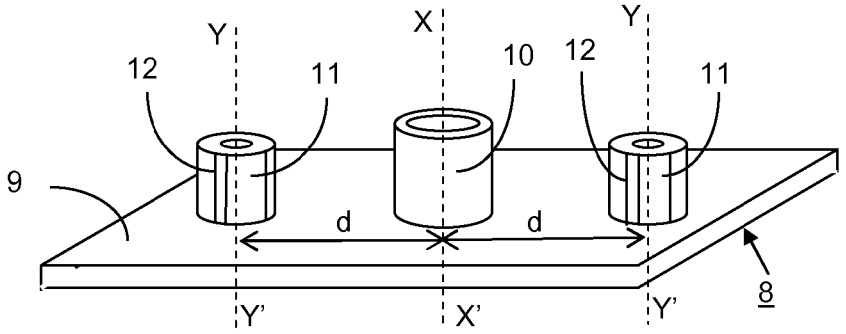
FIG. 3 depicts a detailed view of a spacer of the joining device.

The spacer 8 is depicted in detail in FIG. 3. The spacer 8 comprises a pad 9, which in this case is in the form of a flat rectangle, for example 120 mm×17 mm. The pad 9 supports joining means, such as, in this case, a hollow cylinder 10 that passes through, framed by two pegs 11. The means of joining 10, 11 make it possible to position and associate the radome 2 with the reflector 1, which are then held together by means of fastening 3, 6, 7. The spacer 8 is constructed from a rigid material, preferentially a dielectric material like a plastic, such as acrylonitrile-butadiene-styrene ABS or polyamide PA, which has the advantage of being light and inexpensive. However, the spacer 8 may also be constructed out of metal, such as aluminum, without any impact on radio performance, given that the means of joining, cylinder 10 and pegs 11, are placed between the reflector 1 and the upper brace 4 of the joining device, and are therefore often concealed.

The cylinder 10 is in the shape of a hollow tube with the access X-X' which passes through the pad 9. The outer diameter of the cylinder 10 is adapted to the diameter of the holes built into the radome 2. Here, the outer diameter of the cylinder is, for example, 7 mm. The upper brace 4 also comprises an orifice for allowing the cylinder 10 through. Between the pegs 11, the pad 9 is perforated, and the orifice communicates with the tubular interior of the cylinder 10 so as to enable a bolt 4 to pass through the spacer 8. The cylinder 10 is placed by a hole built into the reflector 1, in order to be able to insert the threaded rod of a bolt 3 through it, for example one 5 mm in diameter, the cylinder 10 serving as a guide for it in this case.

Pegs 11 are disposed at each end of the pad 9 an equal distance d away from the cylinder 10 on each side. It is understood that in this situation, the length of the pad is at least a little more than 2d. The peg 11 has the shape of a cylinder, with the axis Y-Y', which may be solid or hollow depending on the manufacturing technique that is used, placed on the pad 9 with which it is joined. The outer diameter of the peg 11 is adapted to the diameter of the holes built into the radome 2. Here, the outer diameter of the pegs 11, for example 7 mm, is of the same order of magnitude as their height above the pad 9. The outer surface of the peg 11 is equipped with grooved reliefs 12 whose role is to hold the radome 2 in place while preventing it from sliding. When installing the antenna, the pegs 11 are forced into the holes of the radome 2 whose material is just slightly more flexible than the pegs 11. Once in place, the grooved reliefs 12 exert pressure onto the walls of the hole, preventing any undesired movement.

Figure 4:
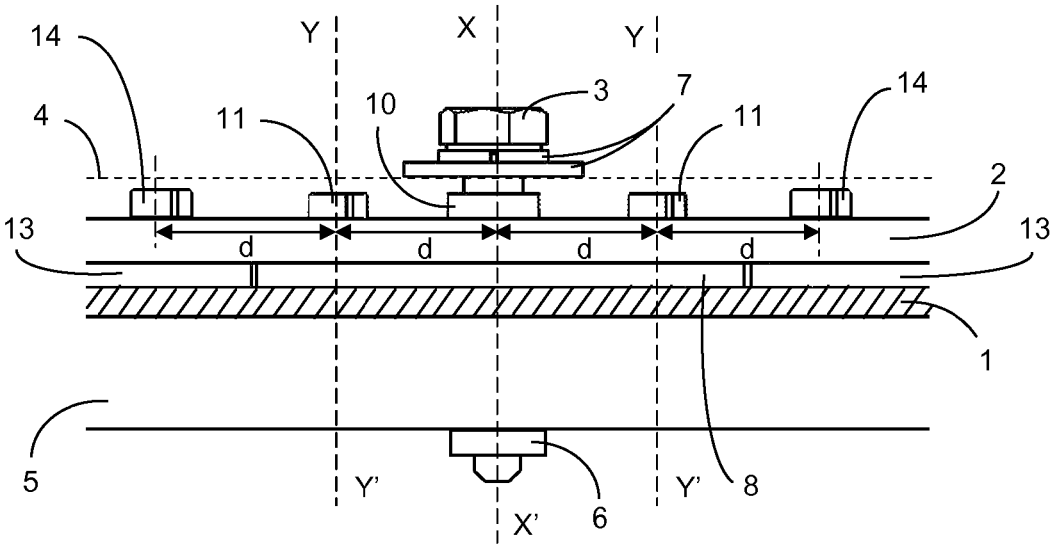
FIG. 4 depicts a longitudinal cross-section along B-B of a zone where the radome fastens onto the reflector in the vicinity of a means of fastening.

As depicted in a longitudinal cross-section along B-B in FIG. 4, the cylinder 10 and the two pegs 11 are inserted into the existing holes that pass through the radome 2, which is placed on the spacer 8. The pad 9 of the spacer 8 is placed on the reflector 1. The lower brace 5 is applied against the opposite face of the reflector 1. The bolt 3 inserted into the cylinder 10 is held tight by the nut 6. For clarity's sake, the upper brace 4 has been removed, its position being represented by a dashed line.

In the present situation, the number of holes in the radome 2 and the distance separating the three existing holes in the radome 2 are the same as in the prior art, in which all those holes were intended to house a bolt. Thus, the distance d separating a peg 11 from the cylinder 10 corresponds to the interval between two successive holes of the radome 2. In this embodiment, only one in three holes accommodates a bolt 3, guided by the cylinder 10, and the holes located on either side enable the passage of the pegs 11. Other analogous spacers 13 may be placed on either side of the spacer 8 in order to cover the entire circumference of the radome 2. The spacers 13 identically support tubular cylinders (not depicted) and pegs 14 which are located a distance d away from the adjacent pegs 11 belonging to the spacer 8.

Figure 5:
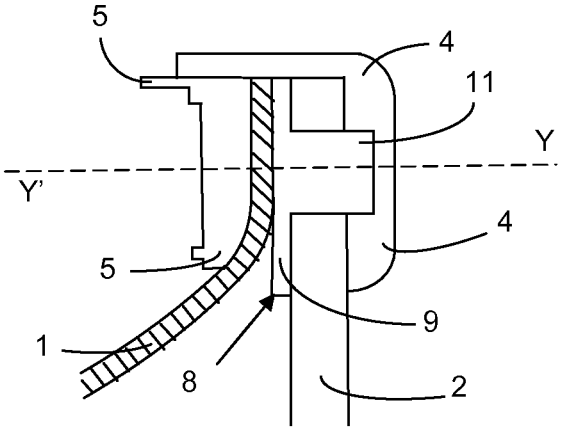
FIG. 5 depicts another, parallel cross-section along A-A of the edge of the antenna at the point of a peg.

A cross-section view parallel to A-A at the point of the peg 11 is depicted in FIG. 5. The pad 9 of the spacer 8 supporting the peg 11 is placed between the reflector 1 and the radome 2. The peg 11 is inserted into a hole of the radome 2. The reflector 1, the spacer 8 and the radome 2 are sandwiched between the upper brace 4 and the lower brace 5. The upper brace 4 covers the upper part of the peg 11 that extends past the surface of the radome 2. As a result, the unevenness created by the pegs 11 is concealed, and there is no noticeable impact on radio performance, even if the pegs 11 are metallic.

The embodiment just described applies to the circumstance in which a circular radome of a known type is used. However, radomes may be manufactured so as to be adapted to this joining device, and particularly the holes might not in such a case be regularly spaced, but rather grouped to match the shape of the spacer. For example, the radome may support groups of three holes spaced a distance d1 apart, each group of holes being d2 apart from the adjacent groups, with d2 being greater than d1. In this case, if d1=14 mm and d2=128 mm, the length of the pad may be 50 mm for example.

Naturally, the present invention is not limited to the described embodiments, but is, rather, subject to many variants accessible to the person skilled in the art without departing from the spirit of the invention. In particular, it is possible without departing from the scope of the invention to modify the quantity of the means of joining such as the number of cylinders and/or the number of pegs supported by each spacer. It is also possible to modify the spaces between the pegs and the cylinders and/or adjacent pegs.

The invention claimed is:

1. A device for joining a rigid flat radome onto a circular-opening antenna reflector comprising:

an upper brace applied to the surface of the radome, turned outward and covering the peripheral segment of the reflector and radome, a lower brace placed against an outer surface of the reflector opposite the radome, at least one rigid spacer comprising and joined with a pad disposed between the reflector and the radome, at least one cylinder leaving a through-hole for a fastener configured to fasten the radome onto the reflector, and at least one peg mating with the radome.

2. A device according to claim 1, wherein the upper brace covers the upper part of the peg.

3. A device according to one claim 1, wherein the upper brace comprises an orifice for allowing the cylinder through.

4. A device according to claim 1, wherein the cylinder has the shape of a hollow tube passing through the pad and capable of fitting into an orifice of the upper brace.

5. A device according to claim 1, wherein the distance separating a peg from a cylinder or an adjacent peg is constant.

6. A device according to claim 1, wherein the dielectric part is made of a polymer material.

7. A device according to claim 1, wherein the fastener configured to fasten the radome onto the reflector is a bolt equipped with a nut.

8. An antenna comprising a circular-opening reflector enclosed by a rigid flat radome and a device for joining the radome onto the reflector, the radome comprising a plurality of holes distributed across its periphery, wherein some of the holes of the radome are used to put a fastener through, and wherein the device for joining the radome onto the reflector comprises at least one rigid spacer comprising and joined with a pad disposed between the reflector and the radome, at least one cylinder leaving a through-hole for a means of fastening the radome onto the reflector, and at least one peg, the cylinder and the peg having an outer diameter adapted to be inserted into the radome's holes.

9. An antenna according to claim 8, wherein only one-third of the radome's holes are used to put the fastener through.

10. An antenna according to claim 8, wherein the joining device comprises:

an upper brace applied to the surface of the radome, turned outward and covering the peripheral segment of the reflector and radome, and a lower brace placed against an outer surface of the reflector opposite the radome.

11. A communication system comprising the antenna according to claim 8.

12. A radio communication system comprising the antenna according to claim 8.

* * * * *